United States Patent [19]

Gattiker

[11] 4,155,380

[45] May 22, 1979

[54] WARP BEAM BEARING FOR A LOOM

[75] Inventor: Ernst Gattiker, Arbon, Switzerland

[73] Assignee: Adolph Saurer Limited, Arbon, Switzerland

[21] Appl. No.: 889,536

[22] Filed: Mar. 23, 1978

[51] Int. Cl.[2] ..... D03D 49/00

[52] U.S. Cl. ..... 139/97; 28/172; 242/58.6

[58] Field of Search ..... 139/1 R, 97, 304; 28/172; 308/22, 24, 27; 66/203; 242/58.6, 79

[56] References Cited

U.S. PATENT DOCUMENTS

| | | | |
|---|---|---|---|
| 2,424,400 | 7/1947 | Kronoff | 139/1 R |
| 2,514,152 | 7/1950 | Darash | 139/97 |
| 3,157,207 | 11/1964 | Pfarrwaller | 139/97 |
| 3,675,686 | 7/1972 | Steiner et al. | 139/1 R |

FOREIGN PATENT DOCUMENTS

| | | | |
|---|---|---|---|
| 800654 | 7/1949 | Fed. Rep. of Germany | 139/97 |
| 480469 | 12/1960 | Switzerland | 139/1 R |

*Primary Examiner*—Henry Jaudon
*Attorney, Agent, or Firm*—Bailey, Dority & Flint

[57] ABSTRACT

A warp beam bearing for a loom which includes a projecting arm carried on each side of the loom frame. A guide surface is provided on each of said arms for receiving a shoe which has an arcuate surface provided thereon. A cylindrical sleeve is detachably secured to each end of the warp or loom beam for supporting said loom beam in said arcuate surfaces of said shoe. A stop surface engages one side of the cylindrical sleeve for properly positioning the beam on the loom. A pivotal spring biased clamp engages the other side of the cylindrical sleeves for pressing the sleeves against the stop surface when said beam is in a running position. A low frictional surface is provided on the clamp where the clamp engages the cylindrical sleeve. In removing the beam from the loom the clamp is pivoted out of engagement with the cylindrical sleeve and the shoe is shifted along the guide surface to a remote position wherein a truck can lift the beam.

6 Claims, 2 Drawing Figures

WARP BEAM BEARING FOR A LOOM

BACKGROUND OF THE INVENTION

The invention relates to a warp-beam bearing of a loom. In weaving, it is usual to secure the warp beam, which has been previously wound with warp yarn in a separate workshop together with drawn-in harness and reeds to the loom for free rotation by means of knock-out spindles which are passed through appropriately dimensioned bores in the loom frames and the ends of the warp beam. This bearing arrangement with knock-out spindles has the disadvantage that the correct adjustment of the heavy warp beam in alignment with the frame bore is difficult. In addition, rust and wear develop at the bearing points of the knock-out spindles.

SUMMARY OF THE INVENTION

According to the invention projecting arms are secured to opposed sides of the frame of the loom which have guide surfaces provided thereon. A bearing brass in the form of a shoe is carried on each of said guide surfaces for receiving cylindrical sleeves which are detachably secured to the end of the warp beam. When the beam is in a running position, a resiliently biased clamp presses the beam into engagement with a stop surface. A low frictional surface is provided on the clamp where said clamp engages the cylindrical sleeve.

The bearing arrangement according to the invention holds the warp beam securely and accurately in the predetermined position and nevertheless renders possible rapid installation and dismounting of the warp beam. Because of the large bearing surface available, the bearing wear can be kept very low. The bearing arrangement according to the invention renders possible the free selection of the materials for the sliding pairs, so that rust can no longer develop.

Accordingly, it is an important object of the invention to provide a warp beam bearing for a loom which properly positions the warp beam on the loom.

Another important object of the present invention is to provide a warp beam bearing which permits readily removable and insertion of a warp beam on a loom.

These and other objects and advantages of the invention will become apparent upon reference to the following specification, attendant claims and drawings.

DESCRIPTION OF A PREFERRED EMBODIMENT

Figure 1:
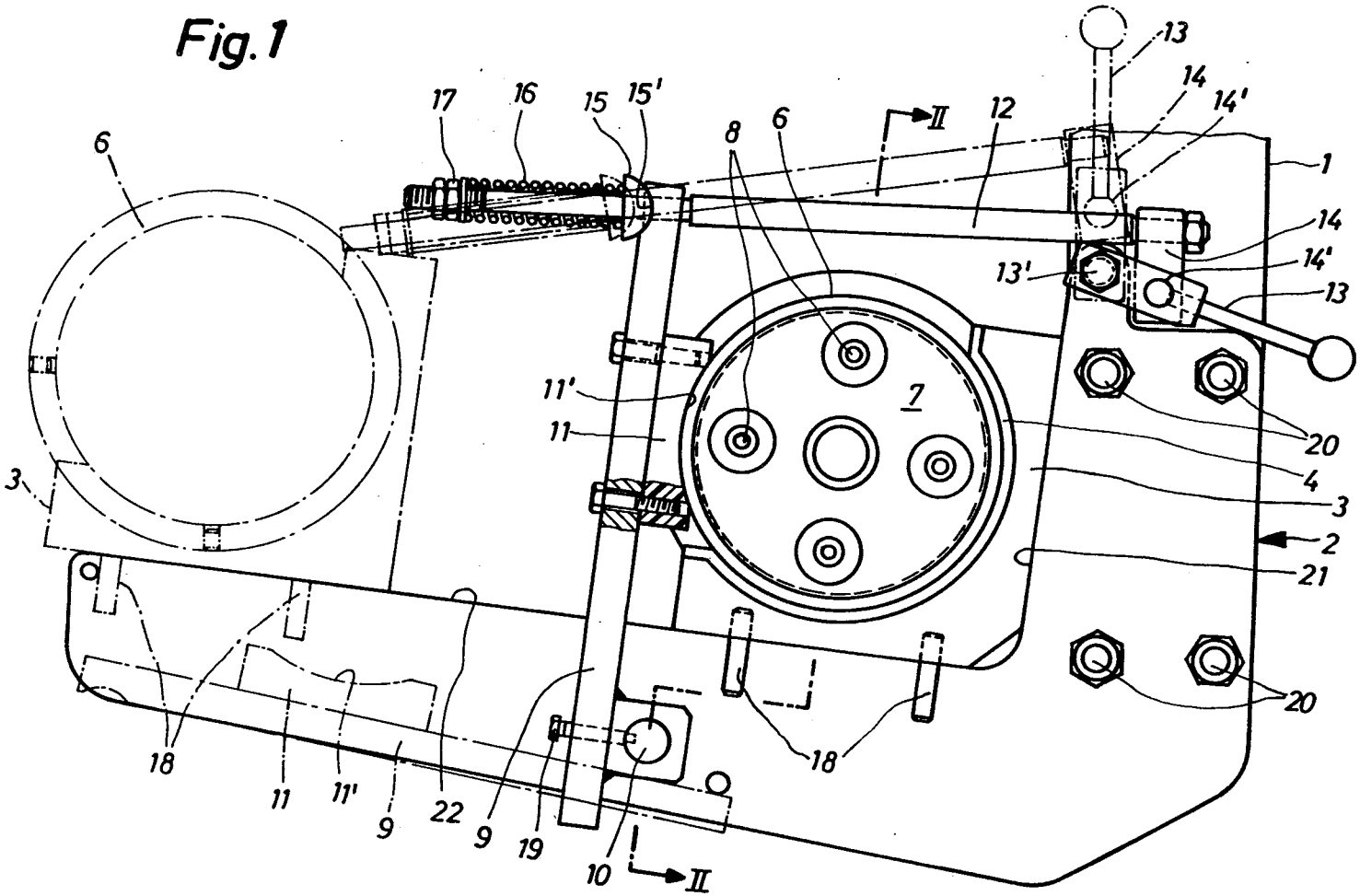
FIG.1 is a side elevational view of a warp beam bearing constructed in accordance with the present invention.

Reference character 1 designates the frame of a loom, to which an arm 2 is screwed by means of attachment screws 20. The projecting arm 2 has a plane guide surface 22 which is inclined so as to fall gently towards the loom and a plane stop surface 21 which is substantially vertical. In the angle which is formed by the stop surface 21 and by the inclined guide surface 22 of the arm 2 there lies half a bearing brass 3 having an arcuate surface and which is constructed in the form of a shoe displaceable on the surface 22. The shoe 3 is laterally located or guided by guide pins 18 disposed at both sides of the arm 2. The bearing opening of the bearing brass 3 is lined with a material 4 having a low coefficient of friction and receives a cylindrical accessory device in the form of a cylindrical sleeve 6 which is secured to the warp or loom beam body 7 by means of attachment screws 8. The accessory device 6 and hence the warp beam is guided laterally by setting rings 5, one of which is secured to the accessory device 6 at each side of the shoe 3. It is to be understood that FIGS. 1 and 2 show the bearing on one side of the loom supporting one end of the loom beam and there is an identical loom beam support on the other side of the loom.

A clamp 9 which is rotatably mounted on the arm 2 by means of pivot pins 10 and which is connected to the pivot pin through screws 19 carries a guide block 11 of low frictional material which comprises, internally, a concave bearing surface 11' pressed against the periphery of the accessory device 6. The compressive force necessary for the pressing is imparted to the clamp via a draw rod 12 which is screwed by one end into a cheek 14. The cheek 14 is pivotally connected, at 14', to a pivotal lever 13 which is articulated on the arm 2 at 13'. The other end of the draw rod, projecting beyond the clamp 9, carries a loose button 15 and, between this and an adjusting nut 17, a compression spring 16. The parts 12 to 17 form a quick closure which is shown in full lines in FIG. 1 in the tightened state wherein the button 15 is pressed against a spherical segment 15' on the clamp 9 so that the clamp 9 with guide block 11 is pressed against the accessory device 6. The cheek 14 assumes its right-hand limit position. The loose position is shown in broken lines, in which the lever 13 is pivoted upwards through about 120 degrees as a result of which the cheek 14 with draw rod 12 is displaced to the left and upwards, with slight pivoting, as seen in FIG. 1. The compression spring is relieved and the button 15 is removed from the cup 15', as a result of which the clamp 9 is relieved and can be swung into the position shown in broken lines (shown in full lines in FIG. 2).

Figure 2:
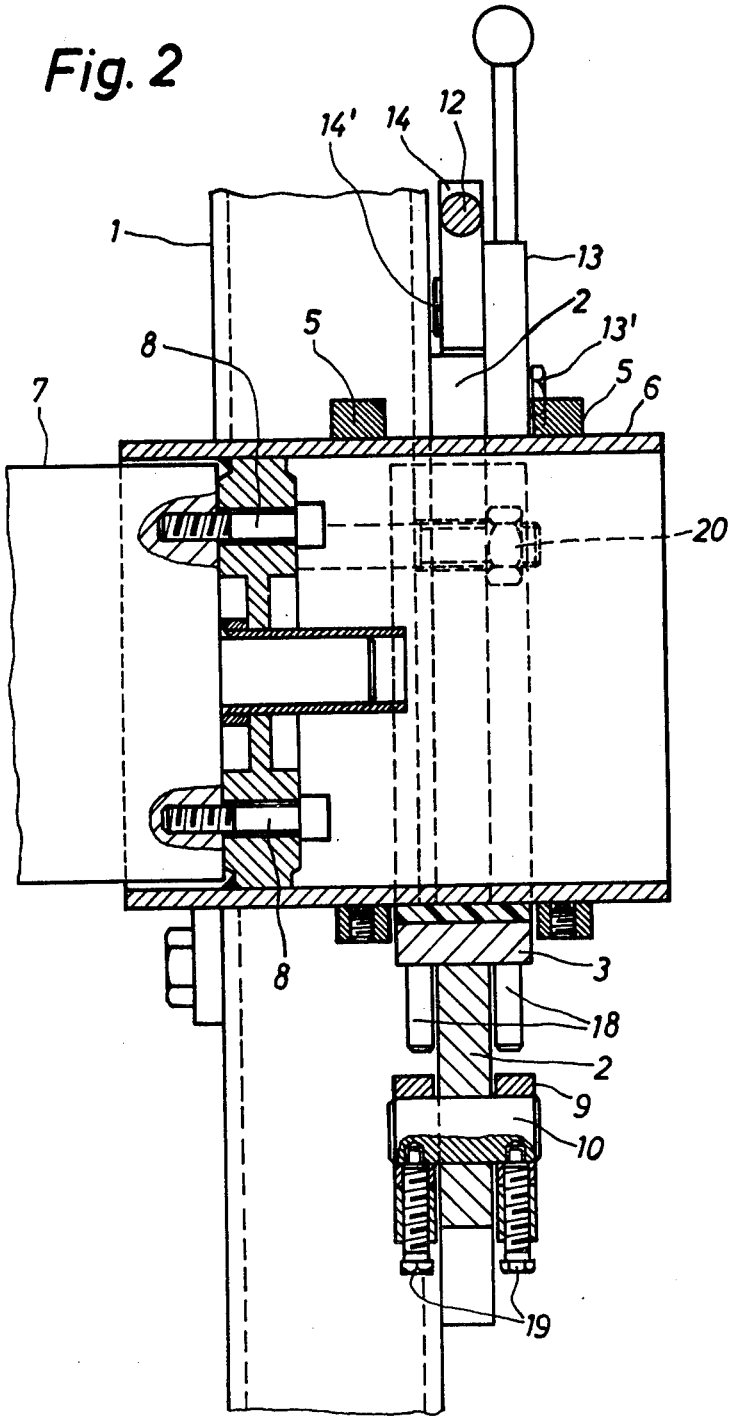
FIG. 2 is a sectional view taken along line 2—2 of FIG. 1.

The warp beam is installed and dismounted as follows:

With the clamp 9 in the lowered position shown in broken lines, the shoes 3 are pushed over the inclined surface 22 to the free end of each projecting arm 2 and then the fully equipped warp beam, which is brought up with a truck is inserted with its accessory devices 6 in the halves of the bearing brasses (shown in broken lines in FIG. 1). Then the warp beam together with the halves of the bearing brasses 3 are pushed back against the stop surface 21, the clamp is raised by hand, the button 15 of the quick closure 12 to 17 is inserted in the spherical segment 15' and the pivotal lever 3 is transferred by hand into the position shown in full lines.

While a preferred embodiment of the invention has been described using specific terms, such description is for illustrative purposes only, and it is to be understood that changes and variations may be made without departing from the spirit or scope of the following claims.

What is claimed is:

1. A warp-beam bearing for a loom having a loom frame comprising:

a projecting arm carried on each side of said loom frame;

a guide surface provided on each of said arms;

a shoe carried by each of said arms having a lower surface which rests on said guide surface;

an arcuate surface provided in each of said shoes;

a cylindrical sleeve detachably secured to each end of said loom beam for supporting said loom beam on said arcuate surfaces of said shoes;

a stop surface engaging said shoe and properly positioning said beam on said loom;

a removable clamp engaging the other side of said cylindrical sleeve pressing said sleeve against said stop surface when said beam is in a running position on said loom; and a low frictional surface carried on said clamp where said clamp engages said cylindrical sleeve.

2. A bearing as set forth in claim 1 further comprising:

said guide surface being substantially planar;

said clamp pressing against said sleeve in a direction substantially parallel to said guide surface and towards said stop surface.

3. A bearing surface as set forth in claim 1 further comprising:

said stop surface is integral with said arm and extends upwardly therefrom;

said guide surface being inclined slightly downwards towards said stop surface; and said guide surface and said stop surface forming a corner for receiving said shoe.

4. The bearing surface as set forth in claim 1 further comprising:

a quick connector carried by said clamp for locking said clamp in engagement with said sleeve when in a locked position; and means for pivoting said clamp out of engagement with said sleeve so as to permit said shoe to be moved along said guide surface for removing said beam from said loom.

5. The bearing as set forth in claim 4 further comprising:

means for resiliently biasing said clamp into engagement with said cylindrical surface.

6. The bearing as set forth in claim 3 further comprising:

guide elements carried on said shoe extending on opposed sides of said arms for guiding said shoe on said arms.

* * * * *